US005857504A

United States Patent [19]

Tremblay

[11] Patent Number: 5,857,504

[45] Date of Patent: Jan. 12, 1999

[54] COLLAPSIBLE FUNNEL

[76] Inventor: Christian Tremblay, 145 Avenue St-Vincent, Ste-Foy, Canada, G2G 1F4

[21] Appl. No.: 78,038

[22] Filed: May 13, 1998

[51] Int. Cl.[6] ..... B67C 11/00

[52] U.S. Cl. ..... 141/338; 141/340; 141/386

[58] Field of Search ..... 141/331–333, 141/337–342, 386

[56] References Cited

U.S. PATENT DOCUMENTS

| | | | |
|---|---|---|---|
| 998,352 | 7/1911 | Kublin | 141/340 |
| 1,242,453 | 10/1917 | Lester | 141/338 |
| 1,420,011 | 6/1922 | Abbott | 141/338 |
| 1,430,691 | 10/1922 | Self et al. | 141/337 |
| 1,461,654 | 7/1923 | Haessler | 141/338 |
| 1,497,048 | 6/1924 | Vodoz | 141/332 |
| 1,503,373 | 7/1924 | Parker | 141/338 |
| 1,563,005 | 11/1925 | Allee | 141/338 |
| 4,703,867 | 11/1987 | Schoenhard | 141/340 |
| 5,445,196 | 8/1995 | Tyree, Jr. | 141/338 |
| 5,607,004 | 3/1997 | Cope | 141/340 |

FOREIGN PATENT DOCUMENTS

| | | | |
|---|---|---|---|
| 619539 | 4/1927 | France | 141/338 |
| 344969 | 5/1921 | Germany | 141/338 |
| 230659 | 3/1925 | United Kingdom | 141/338 |

*Primary Examiner*—J. Casimer Jacyna

[57] ABSTRACT

The present invention relates to a collapsible funnel that is easily adaptable to a variety of liquid receptacles, with an associated moveable rod, extending within the funnel, connected to a screw cap which provides for the funnel to be pushed into a liquid receptacle, through a filling spout therein, in a collapsed position when not in use. The collapsible funnel needs to be pulled out of the liquid receptacle to automatically assume a standing and extended operative position over and in association with the spout and facilitates the filling of the liquid receptacle, especially when moveable rod with screw cap partially clear the way in order for funnel to easily receive the liquid.

15 Claims, 2 Drawing Sheets

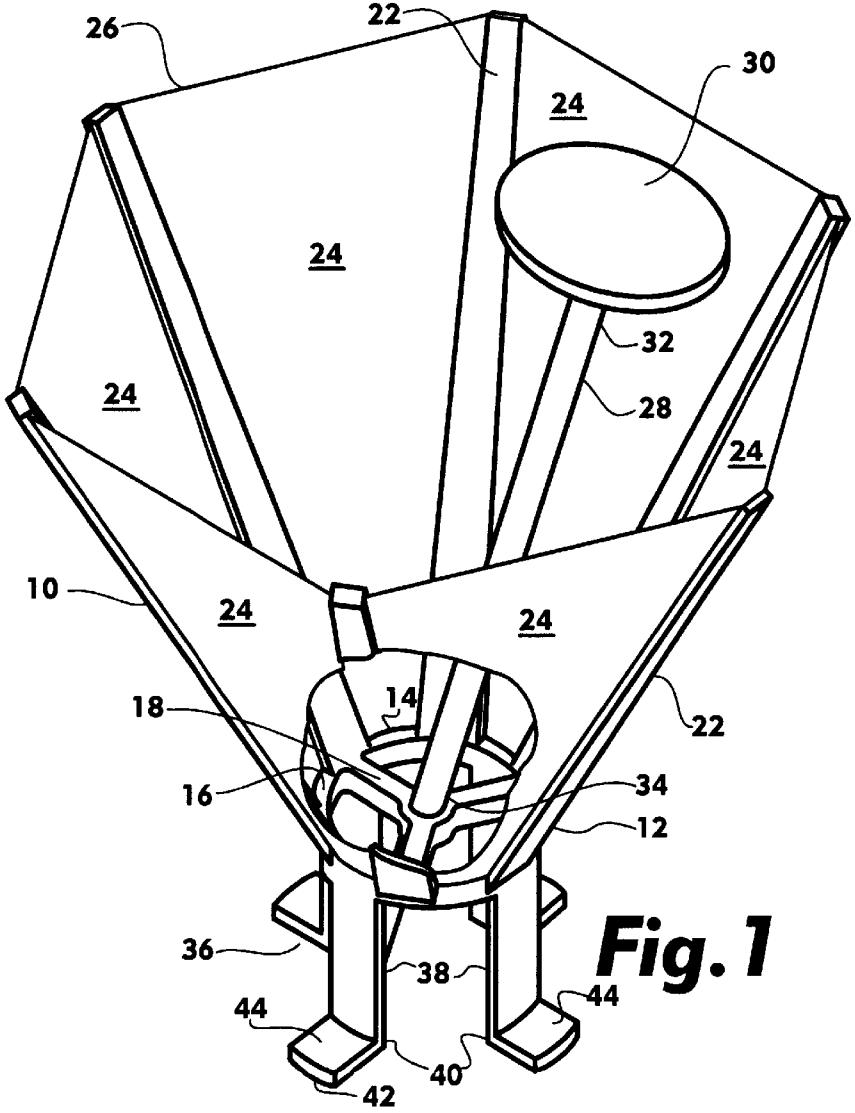
Fig. 1
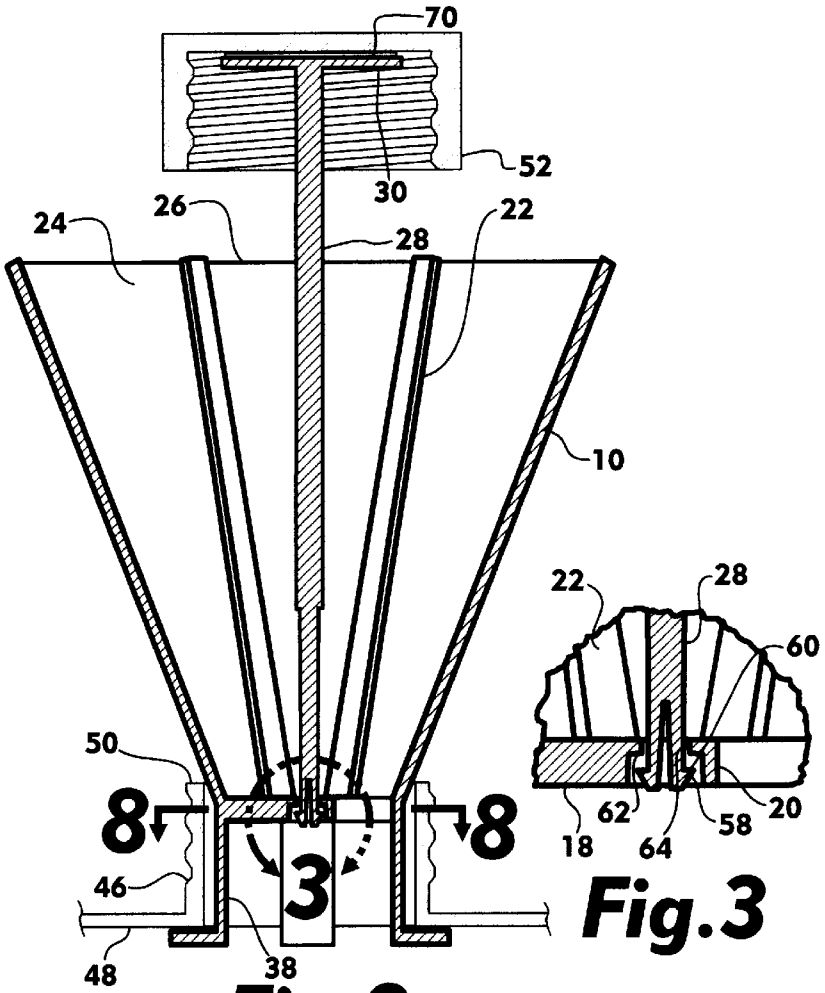
Fig. 2
Fig. 3

28
22
72
20
54
64
18
68

64
16
18
14
76
20

52
46
48
70
28
22
7
30
74
10
38
42

28
54
10
20
62
60
58
22
64
18

52
66
70
28
10
30
22
26
24
5
38
50
46
48

COLLAPSIBLE FUNNEL

FIELD OF THE INVENTION

The present invention relates to funnels and more particularly to collapsible funnels.

BACKGROUND OF THE INVENTION

Prior patents for collapsible funnels have been issued. Most of these inventions provide for collapsible funnels to be inserted and enclosed into liquid receptacles and to spring out when the closing cap is removed. Later improvements also included rods to push funnels into or pull them out of necks or filling spouts of various liquid receptacles such as automobile radiators, when not being used or when in operative position respectively.

U.S. Pat. No. 1,461,654 dated Jul. 10, 1922 to W. J. Haessler discloses a collapsible funnel with a rod vertically arranged within the funnel and inseparably attached to a screw cap. The limitation of the prior art is that the rod and the cap are in the way, since the rod is unmoveable, when the user pours a given liquid into the funnel, such an arrangement makes it difficult to use the device, causes spillage, accidental splashing and gets liquid onto the screw cap which the user wants to avoid.

OBJECTS OF THE INVENTION

It is an object of the present invention to provide a collapsible funnel and an associated moveable rod extending within the funnel which obviate the above mentioned disadvantages.

It is another object of the present invention to provide a collapsible funnel that is easily adaptable to a variety of liquid receptacles with filling spouts and facilitates filling of such liquid receptacles.

It is a further object of the present invention to provide a collapsible funnel that is readily available when needed and easily withdrawn to automatically expand and assume a fixed operative position in combination with the filling spout of a liquid receptacle and which cannot easily be accidentally displaced from the filling spout.

It is still another object of the present invention to provide a moveable rod attached to a cap that can be pivoted to partially clear the top edge of the funnel when it assumes an expanded operative position in order to avoid accidental splashing or spillage due to the rod and the cap.

It is yet another object of the present invention to provide a collapsible funnel with a strainer that can filter objectionable materials when filling the liquid receptacle.

It is yet a further object of the present invention to provide a collapsible funnel that is light, easy to use and assemble, and relatively inexpensive.

SUMMARY OF THE INVENTION

In combination with a liquid receptacle having a filling spout and a screw cap for closing the spout; the collapsible funnel of the present invention is for insertion into the receptacle through the spout when collapsed and extending over the spout when erected, a wheel-like member having a rim to which the lower, smaller end of the funnel is secured and having a hub connected to the rim by spokes, a rod having an upper end secured to the inside of the cap, extending within the funnel and having a lower end connected to the hub for rotation and pivotal movement relative to the hub, the rod maintaining the cap at a distance from the hub to clear the upper edge of the funnel, and a stop secured to and depending from the wheel-like member away from the funnel, and having a receptacle abutting portion downwardly spaced from the wheel-like member, wherein the funnel, rod, wheel-like member and stop extend within the spout and receptacle and the cap closes the spout in the collapsed position of the funnel, and wherein the stop extends through the spout, the abutting portion abuts the receptacle around the spout and the wheel-like member is located at the level of the free end of the spout with the rod inclined and resting on the free top edge of the funnel and with the cap partially clearing the free top edge.

Preferably, the stop is formed by downwardly extending legs spaced around and depending from the rim and the abutting portion is formed by radially outward projections at the lower free ends of the legs.

Preferably, the projections have a radially outwardly, substantially horizontal upper face.

Preferably, the funnel includes spaced arms and an intervening flexible membrane integrally joined to the arms and to the rim, the arms integrally joined to and outwardly biased from the rim.

Preferably, the hub has a through hole and the lower end of the rod forms a restricted portion freely extending through the hole to permit rotation and inclination of the rod relative to the wheel-like member, and a pair of shoulders engaging opposite sides of the hub to permit the rod to push the wheel-like member to collapse the funnel, and to pull the wheel-like member to erect the funnel.

Preferably, the funnel further includes a disc secured to the upper end of the rod for adhering to the inside of the cap.

Preferably, the upper end of the cap is integral with the cap.

The funnel assembly of the present invention may also be for attaching to a liquid receptacle having a filling spout and a screw cap for closing the spout, the assembly comprising a collapsible funnel for insertion into the receptacle through the spout when collapsed and extending over the spout when erected, a wheel-like member having a rim to which the lower, smaller end of the funnel is secured and having a hub connected to the rim by spokes, a rod having an upper end adapted to be secured to the inside of the cap, extending within the funnel and having a lower end connected to the hub for rotation and pivotal movement relative to the hub, the rod of a length to maintain the cap at a distance from the hub to clear the upper edge of the funnel, and a stop secured to and depending from the wheel-like member away from the funnel, and having a receptacle abutting portion downwardly spaced from the wheel-like member, wherein the funnel, rod, wheel-like member and stop are adapted to extend within the spout and receptacle and the cap can close the spout in the collapsed position of the funnel, and wherein the stop is adapted to extend through the spout, the abutting portion is adapted to abut the receptacle around the spout and the wheel-like member is adapted to be located at the level of the free end of the spout with the rod inclined and resting on the free top edge of the funnel and with the cap when secured to the rod partially clearing the free top edge.

Preferably, the funnel includes spaced arms and an intervening flexible membrane integrally joined to the arms and to the rim, the arms integrally joined to and outwardly biased from the rim.

Preferably, the stop is formed by downwardly extending legs spaced around and depending from the rim and the abutting portion is formed by radially outward projections at the lower free ends of the legs and wherein the projections have a radially outwardly, substantially horizontal upper face.

Preferably, the hub has a through hole and the lower end of the rod forms a restricted portion freely extending through the hole to permit rotation and inclination of the rod relative to the wheel-like member, and a pair of shoulders engaging opposite sides of the hub to permit the rod to push the wheel-like member to collapse the funnel, and to pull the wheel-like member to erect the funnel.

Preferably, the funnel further includes a disc secured to the upper end of the rod for adhering to the inside of the cap.

BRIEF DESCRIPTION OF THE DRAWINGS

In the annexed drawings, like reference characters indicate like elements throughout.

FIG. 1 is a partially broken perspective view of the preferred embodiment of the present invention showing a collapsible funnel in an extended position;

FIG. 2 is a front sectional view of the preferred embodiment showing the funnel attached to and extended over a spout of a liquid container with a rod in a straight and fully lifted position and attached to a screw cap;

FIG. 3 is an enlarged view of area 3 of FIG. 2;

DETAILED DESCRIPTION OF THE PREFERRED EMBODIMENT

Figures 4, 5, 6, 7, 8:
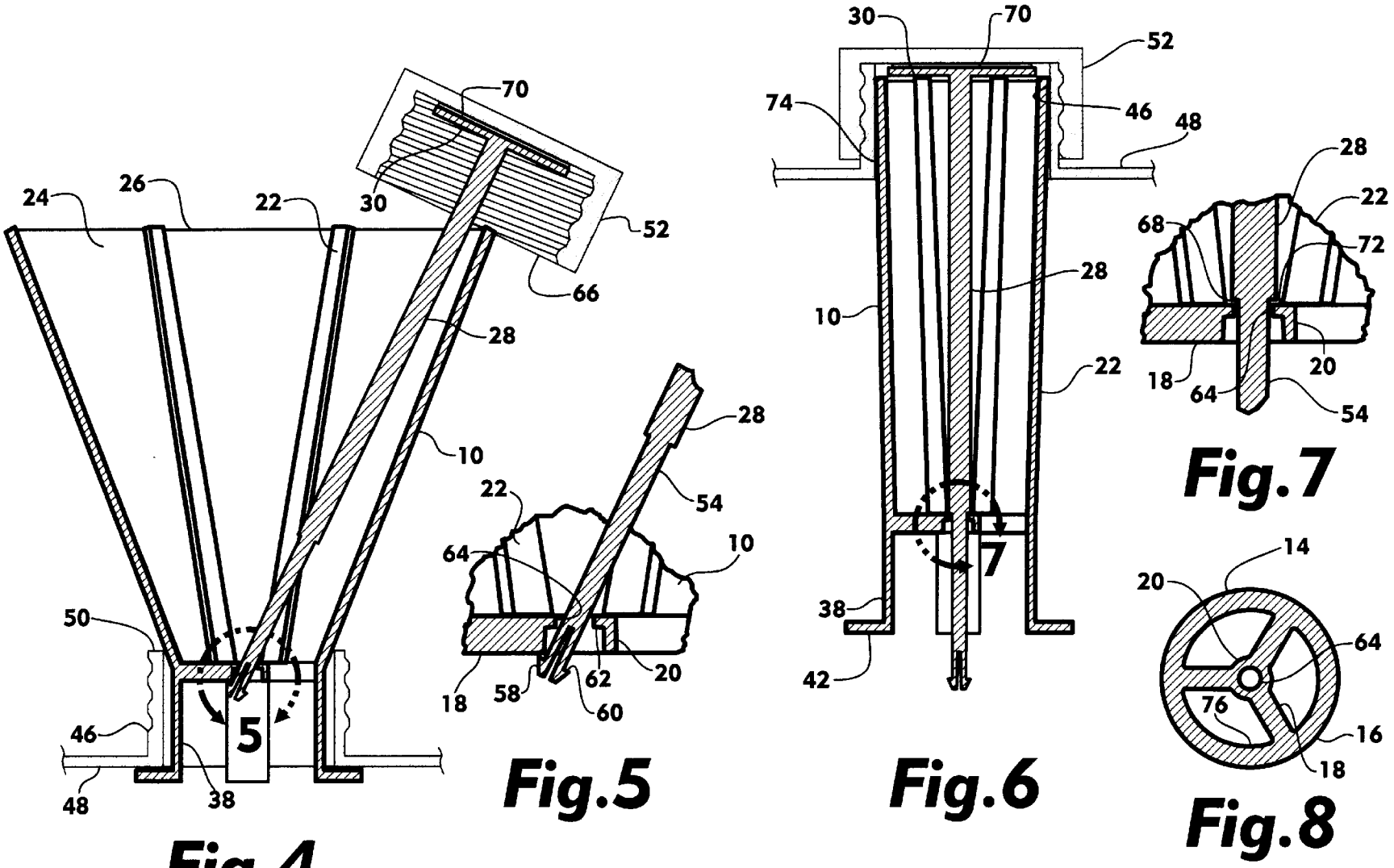
FIG. 4 is a front sectional view of the preferred embodiment similar to FIG. 2 with the rod in a fully inclined position.
FIG. 5 is an enlarged view of area 5 of FIG. 4.
FIG. 6 is a front sectional view of the preferred embodiment showing the funnel in a collapsed position.
FIG. 7 is an enlarged view of area 7 of FIG. 6.
FIG. 8 is a sectional top view along line 8—8 of FIG. 2.

Referring to FIGS. 1 through 8 the preferred embodiment of the present invention will be herein described for indicative purposes and by no means as of limitation.

FIG. 1 shows the preferred embodiment of the present invention wherein funnel 10 is in a fully erected and extended position with its smaller and lower end 12 being secured on to rim 14 of a wheel-like member 16, wheel-like member 16 preferably having radially oriented spokes 18 projecting inwardly from rim 14 and connected to a central annular hub 20. FIG. 1 also illustrates funnel 10 having a plurality of resilient, spaced arms 22 integrally joined to and outwardly biased from rim 14, arms 22, preferably made out of thermoplastic material, constitute the supporting frame of the body of funnel 10. Arms 22 are also shown being integrally joined to intervening flexible membranes 24, wherein flexible membranes 24 are made out of non-permeable material, preferably thin rubber like material. When funnel 10 is in a fully erect and extended position as in FIG. 1, arms 22 and membranes 24 form a substantially wide, relative to lower end 12, top edge 26. The extended position allows for the funnel 10 to easily receive a variety of liquids.

Referring again to FIG. 1 there is also drawn rod 28 extending within funnel 10 and shown here being inclined approximately midway between the straight standing position (see FIG. 2) and the fully inclined resting position (see FIG. 4), with disc 30 secured on its upper end 32, and having its lower end 34, preferably of a split-arrow like shape, removably connected to hub 20 for rotation and pivotal movement relative to hub 20. Disc 30 is adapted to allow a user to rotate and tilt rod 28.

Also illustrated are stops 36, secured and dependant to wheel-like member 16 away from funnel 10, being formed by downwardly extending and preferably resilient legs 38 spaced around and depending from rim 14. Legs 38 having on their free ends 40 a receptacle abutting portion being short outward projections 42 radially extending from the free ends 40. Legs 38 and projections 42 preferably being made out of a resilient thermoplastic material.

FIG. 2 shows the present invention with funnel 10 in a fully erected and extended position and with rod 28 in a generally straight standing and fully lifted position. Stop legs 38 are extended through filling spout 46 of a given liquid receptacle 48 with outward projections 42 abutting liquid receptacle 48 around spout 46, spout 46 being adapted to receive a closing screw cap 52. Funnel 10 is stable in its fully erected position with its lower end of resilient arms 22 abutting the inner top rim 50 of spout 46 and with upper faces 44 of the outward projections 42 abutting the liquid receptacle 48. The standing, extended position provides for funnel 10 in combination with filling spout 46 to easily fill liquid receptacle 48, when the user pours liquid into funnel 10, without accidental splashing or spilling. Disc 30 is secured to upper end 32 of rod 28 and adhering, preferably an adhesive substance 70, to the inside of cap 52 of the liquid receptacle 48. The present invention may also provide for the upper end 32 of rod 28 to be integral to screw cap 52. The foregoing connections between rod 28 and cap 52 provide for using cap 52 to rotate, pivot, lift up or push down rod 28. Rod 28 serves as a means for inseparably holding screw cap 52 in association with the present funnel device. Rod 28 is also shown having a lower restricted portion 54.

The resiliency of the legs 38 with the outward projections 42 enable projections 42 to be radially squeezed in along the inner peripheral side 56 of spout 46 so as to allow for the funnel 10 to be slidably pushed down into the spout 46 during its insertion into the spout 46 of the liquid receptacle 48.

FIG. 3 shows the split arrow-like end 58 of lower restricted portion 54 having lower annular shoulder 60 which abuts against the bore 62 of hub 20 permitting rod 28 to pull wheel-like member 16 up, thus, erecting funnel 10 to fully extended position as shown in FIG. 2. The split arrow-like end 58 allows for a relatively easy insertion of rod 28 into wheel-like member 16.

FIG. 4 illustrates the present invention in an erect and fully extended position with rod 28 in a fully inclined rested position. The rested position is provided when rod 28 is radially pivoted, after the user pulls it up to its fully erected position as in FIG. 3, to a given direction until it hits the top edge 26 of funnel 10, and released allowing lower restricted portion 54 of rod 28 to slide down through hole 64 of annular hub 20 to a depth determined by bottom face rim 66 of cap 52 engaging onto the free top edge 26 of funnel 10. Thus, cap 52 partially clears top edge 26 allowing for the user to pour a liquid into funnel 10 on the opposite side of rod 28 and cap 52 without getting any liquid on cap 52 or any upper portion of rod 28, hence, again avoiding accidental splashing or spilling.

FIG. 5 shows the restricted portion 54 completely tilted within hole 64 of annular hub 20 into liquid receptacle 48 to allow for rested position of rod 28.

FIG. 6 illustrates the preferred embodiment of the present invention in a collapsed position inserted into the liquid receptacle 48 through spout 46 when funnel 10 is not in use. Cap 52 is screwed onto spout 46, enclosing funnel 10 into liquid receptacle 48, and attached to disc 30, permitting rod 28 to hang from disc 30 hence, avoiding funnel 10 from falling into liquid receptacle 48. The collapsed position is achieved when arms 22 of funnel 10 are straightened as funnel 10 is pushed down into spout 46. When the present funnel 10 is enclosed within the liquid receptacle 48, the collapsed position is maintained as upper portions 74 of resilient arms 22 are radially pushing against the inner peripheral side 56 of spout 46 keeping arms 22 in a generally straight vertical position.

In order to move the funnel 10 into its collapsed position, the user pushes down the rod 28 until the upper annular shoulder 68 defining the top end of the restricted portion 54 abuts against the top side 72 of annular hub 20, as shown in FIG. 7.

When cap 52 is unscrewed from spout 46 and lifted, shoulder 60 of lower restricted portion 54 of rod 28 pulls up wheel-like member 16, which erects funnel 10 out of liquid receptacle 48. Funnel 10 automatically assumes an extended operative position, provided by resilient arms 22, which deploy flexible membranes 24, enabling the present funnel device to easily receive a liquid into its filling space and fill liquid receptacle 48.

FIG. 8 is a top view of wheel-like member 16 shown having radial spokes 18 projecting inwardly from rim 14 to central annular hub 20 defining hole 64. Hole 64 providing for rod 28 to be rotated, pivoted, slid up and down relatively to hub 20. Also shown are openings 76 which are placed between radial spokes 18 allowing a given liquid to flow into liquid receptacle when funnel 10, positioned as in FIG. 4, is being filled with a given liquid. A strainer may also be placed on radial spokes 18 covering openings 76 and filtering relatively large dust particles when filling.

I claim:

1. In combination with a liquid receptacle having a filling spout and a screw cap for closing said spout; a collapsible funnel for insertion into said receptacle through said spout when collapsed and extending over said spout when erected, a wheel-like member having a rim to which the lower, smaller end of said funnel is secured and having a hub connected to said rim by spokes, a rod having an upper end secured to the inside of said cap, extending within said funnel and having a lower end connected to said hub for rotation and pivotal movement relative to said hub, said rod maintaining said cap at a distance from said hub to clear the upper edge of said funnel, and a stop secured to and depending from said wheel-like member away from said funnel, and having a receptacle abutting portion downwardly spaced from said wheel-like member, wherein said funnel, rod, wheel-like member and stop extend within said spout and receptacle and said cap closes said spout in the collapsed position of said funnel, and wherein said stop extends through said spout, said abutting portion abuts said receptacle around said spout and said wheel-like member is located at the level of the free end of said spout with said rod inclined and resting on the free top edge of said funnel and with said cap partially clearing said free top edge.

2. The combination as defined in claim 1, wherein said stop is formed by downwardly extending legs spaced around and depending from said rim and said abutting portion is formed by radially outward projections at the lower free ends of said legs.

3. The combination as defined in claim 2 wherein said projections have a radially outwardly, substantially horizontal upper face.

4. The combination as defined in claim 1 wherein said funnel includes spaced arms and an intervening flexible membrane integrally joined to said arms and to said rim, said arms integrally joined to and outwardly biased from said rim.

5. The combination as defined in claim 4 wherein said stop is formed by downwardly extending legs spaced around and depending from said rim and said abutting portion is formed by radially outward projections at the lower free ends of said legs and wherein said projections have a radially outwardly, substantially horizontal upper face.

6. The combination as defined in claim 5, wherein said hub has a through hole and said lower end of said rod forms a restricted portion freely extending through said hole to permit rotation and inclination of said rod relative to said wheel-like member, and a pair of shoulders engaging opposite sides of said hub to permit said rod to push said wheel-like member to collapse said funnel, and to pull said wheel-like member to erect said funnel.

7. The combination as defined in claim 6, further including a disc secured to said upper end of said rod for adhering to the inside of said cap.

8. The combination as defined in claim 1 wherein said hub has a through hole and said lower end of said rod forms a restricted portion freely extending through said hole to permit rotation and inclination of said rod relative to said wheel-like member, and a pair of shoulders engaging opposite sides of said hub to permit said rod to push said wheel-like member to collapse said funnel, and to pull said wheel-like member to erect said funnel.

9. The combination as defined in claim 1 further including a disc secured to said upper end of said rod for adhering to the inside of said cap.

10. The combination as defined in claim 1 wherein said upper end of said cap is integral with said cap.

11. A funnel assembly for attaching to a liquid receptacle having a filling spout and a screw cap for closing said spout, said assembly comprising a collapsible funnel for insertion into said receptacle through said spout when collapsed and extending over said spout when erected, a wheel-like member having a rim to which the lower, smaller end of said funnel is secured and having a hub connected to said rim by spokes, a rod having an upper end adapted to be secured to the inside of said cap, extending within said funnel and having a lower end connected to said hub for rotation and pivotal movement relative to said hub, said rod of a length to maintain said cap at a distance from said hub to clear the upper edge of said funnel, and a stop secured to and depending from said wheel-like member away from said funnel, and having a receptacle abutting portion downwardly spaced from said wheel-like member, wherein said funnel, rod, wheel-like member and stop are adapted to extend within said spout and receptacle and said cap can close said spout in the collapsed position of said funnel, and wherein said stop is adapted to extend through said spout, said abutting portion is adapted to abut said receptacle around said spout and said wheel-like member is adapted to be located at the level of the free end of said spout with said rod inclined and resting on the free top edge of said funnel and with said cap when secured to said rod partially clearing said free top edge.

12. A funnel assembly as defined in claim 11, wherein said funnel includes spaced arms and an intervening flexible membrane integrally joined to said arms and to said rim, said arms integrally joined to and outwardly biased from said rim.

13. A funnel assembly as defined in claim 12, wherein said stop is formed by downwardly extending legs spaced around and depending from said rim and said abutting portion is formed by radially outward projections at the lower free ends of said legs and wherein said projections have a radially outwardly, substantially horizontal upper face.

14. A funnel assembly as defined in claim 13, wherein said hub has a through hole and said lower end of said rod forms a restricted portion freely extending through said hole to permit rotation and inclination of said rod relative to said wheel-like member, and a pair of shoulders engaging opposite sides of said hub to permit said rod to push said wheel-like member to collapse said funnel, and to pull said wheel-like member to erect said funnel.

15. A funnel assembly as defined in claim 14 further including a disc secured to said upper end of said rod for adhering to the inside of said cap.

* * * * *